US010850916B2

(12) United States Patent
Guirguis et al.

(10) Patent No.: US 10,850,916 B2
(45) Date of Patent: Dec. 1, 2020

(54) CONTAINER FOR PROTECTING BAKED GOODS

(71) Applicant: Inline Plastics Corp., Shelton, CT (US)

(72) Inventors: Sameh Guirguis, Monroe, CT (US); Victor Ivenitsky, South Salem, NY (US); Daniel A. Landan, Milford, CT (US); Roman D'Alessandro, Brookfield, CT (US); Steve Introne, Oxford, CT (US); Herb Knutson, Waterbury, CT (US)

(73) Assignee: Inline Plastics Corp., Shelton, CT (US)

( * ) Notice: Subject to any disclaimer, the term of this patent is extended or adjusted under 35 U.S.C. 154(b) by 0 days.

(21) Appl. No.: 16/156,057

(22) Filed: Oct. 10, 2018

(65) Prior Publication Data

US 2019/0055082 A1 Feb. 21, 2019

Related U.S. Application Data

(62) Division of application No. 15/680,979, filed on Aug. 18, 2017, now abandoned.

(51) Int. Cl.

| | |
|---|---|
| ***B65D 85/36*** | (2006.01) |
| ***B65D 51/24*** | (2006.01) |
| ***B65D 43/16*** | (2006.01) |
| ***B65D 1/36*** | (2006.01) |

(52) U.S. Cl.

CPC ..... *B65D 85/36* (2013.01); *B65D 1/36* (2013.01); *B65D 43/162* (2013.01); *B65D 51/245* (2013.01)

(58) Field of Classification Search

CPC ..... B65D 85/36; B65D 1/36; B65D 43/162; B65D 51/245

USPC ..... 206/564, 521.1

See application file for complete search history.

(56) References Cited

U.S. PATENT DOCUMENTS

| | | | | |
|---|---|---|---|---|
| 3,356,277 | A * | 12/1967 | Hohnjec | B65D 85/324 206/521.1 |
| 4,465,225 | A * | 8/1984 | Bixler | B65D 85/32 206/521.1 |
| 5,858,428 | A * | 1/1999 | Truscello | A23G 1/502 426/103 |
| 6,003,671 | A * | 12/1999 | McDonough | B65D 43/162 206/493 |
| 6,231,906 | B1 * | 5/2001 | Alessi | B65D 43/162 426/106 |
| D592,077 | S * | 5/2009 | Sipe | D9/420 |
| 2006/0060493 | A1 * | 3/2006 | Marshall | B65D 75/24 206/521.1 |
| 2010/0147730 | A1 * | 6/2010 | Archambault | B65D 85/32 206/521.1 |

(Continued)

*Primary Examiner* — Steven A. Reynolds

(74) *Attorney, Agent, or Firm* — McCarter & English, LLP; David J. Silva, Esq.

(57) ABSTRACT

Disclosed is a container for protecting baked goods during shipment that includes, among other elements, a lid and a base. The base includes a plurality of wells and interconnected posts. Each well is adapted for supporting a baked good during shipment. The interconnected posts are formed in the base and extend upwardly from a base bottom. Each post is positioned adjacent to at least one of the wells and includes a retainer shoulder that is positioned proximate an upper end of the post and adapted to positively capture baked goods in each of the adjacent wells.

14 Claims, 7 Drawing Sheets

(56) References Cited

U.S. PATENT DOCUMENTS

| | | | | |
|---|---|---|---|---|
| 2013/0004625 | A1* | 1/2013 | Brummer | B65D 1/36<br>426/119 |
| 2013/0048527 | A1* | 2/2013 | Ramirez | B65D 71/0096<br>206/521.1 |
| 2013/0199959 | A1* | 8/2013 | Parikh | B65D 21/045<br>206/507 |

* cited by examiner

CONTAINER FOR PROTECTING BAKED GOODS

BACKGROUND OF THE INVENTION

1. Field of the Invention

The subject disclosure relates to containers for protecting baked goods, and more particularly to containers that include a lid and a base and have a retainer elements formed in the base for restricting the movement of the baked goods when the container is closed and preventing damage during shipment.

2. Background of the Related Art

Baked goods, such as cupcakes and the like, typically include two elements: a main body that is usually baked from a composition of flour and other ingredients and a decorative crown. The crown is usually deposited on the main body although it can be added before or even during the baking process. However, the crown is usually more delicate and can be easily distorted if it is touched by a person or material, or if the cupcake falls on its side or upside down. Very often the crown can be made of frosting, whipped topping, soft cream or other similar, often pasty or semi-liquid compositions.

Baked goods of this kind are very popular deserts and, as a result, a large number of them are being produced in bakeries, shipped to retail outlets and then sold to customers who then carry them home. However, because their tops are very fragile, the cupcakes are easily damaged during shipping, thereby losing at least some of their aesthetic appeal. This is an especially acute problem when a customer buys some cupcakes and takes them as a gift to someone else. In this latter situation, presenting cupcakes with damaged crowns can be socially embarrassing.

U.S. Patent Application Publication 2009/0242569 to Solomon discloses one attempt at reducing the damage to the cupcake crown during shipment. The Solomon publication discloses a food product package that includes a base, a cover, and an insert. The cover is fastened to the base and then insert, which could be paperboard, is disposed between the base and the cover. A body of the base includes at least one pocket adapted to hold a food product, such as a cupcake. After the base is loaded with the cupcakes, the insert is positioned onto the base such that an edge portion of the insert contacts the food product. When the cover is fastened to the base, a portion of the cover presses the insert against the base to thereby securely hold the food product in place. A disadvantage of this construction is that it requires the additional step of positioning the insert onto the base prior to closing the container. Not only does this additional element, the insert, increase the cost of the packaging, it makes automating the process more difficult and results in a package which is less aesthetically pleasing to the consumer.

Another attempt at reducing the damage caused to the crown of the cupcake during shipment is disclosed in U.S. Patent Application Publication 2014/0363555 to Simpson et al. The Simpson publication discloses a cupcake tray which has spikes, such as paperboard spikes, that extend into a cupcake cavity. The spikes prevent the cupcake from popping up and out of the insert when the cupcake box is jarred. The spikes easily fold down when the cupcake is inserted, but provide resistance in the upward direction when the cupcake box is jarred. A disadvantage associated with this package design is that the paperboard spikes rely on friction to hold the cupcakes and do not positively capture the cupcake within the tray.

There is, therefore, a need for a baked goods storage container which positively captures or restrains the baked goods, such as cupcakes, and keeps them from moving around inside the storage container, even when the container is tipped or turned over.

SUMMARY OF THE INVENTION

The present disclosure is directed to a container for protecting baked goods during shipment that includes, among other elements, a lid and a base. The base includes a plurality of wells and interconnected posts. Each well is adapted for supporting a baked good prior to consumption and during shipment. The interconnected posts are formed in the base and extend upwardly from a base bottom. Each post is positioned adjacent to four of the wells and includes at least one retainer element that is positioned proximate an upper end of the post and is adapted to restrain the at least one of the baked goods and restrict its axial movement within the well. In certain embodiments, the retainer elements are horizontally-projecting or formed such that they extend horizontally from the post.

In a preferred embodiment, the retainer element associated with the upper end of each post includes four ribs which are formed around the periphery of the post, each rib projecting horizontally outward from the post over one of the adjacent wells. In certain constructions, the retainer elements or ribs are formed by creating an undercut in the posts of the base. It is envisioned that each retainer element could include a single rib element which is adapted to restrain one of the four adjacent food items/baked goods.

Preferably, the lid includes a planar upper surface for supporting a product label. It is envisioned that the lid can further include a plurality of downwardly projecting spacer elements which extend from the upper planar surface and engage the upper surface of a corresponding post element.

In a preferred embodiment, the lid is connected to the base through a hinge element to form a unitary structure. However, those skilled in the art will readily appreciate that the lid and the base can be formed separately and the container can be a two-piece design.

In certain constructions, the number of wells "W" formed in the base is defined by the formula $W=R\times C$; wherein "R" equals the number of well rows and "C" equals the number or well columns. Still further, the number of posts "P" formed in the base is defined by the formula, $P=(R-1)\times(C-1)$.

Preferably, the upper surface of each well that is formed around a perimeter of the base includes at least two retaining ledges that are preferably, horizontally projecting. Still further, in this embodiment the upper surface of each well that is formed in a corner of the base can include three retaining ledges.

It is envisioned that the baked good can be a cupcake that has a cake portion and a decorative crown and the retaining element is positioned to positively capture an upper edge of the cake portion. However, the cupcake can be contained in a baking liner. In such a construction, the retaining element can be adapted to extend over an upper edge of the baking liner to positively capture the cupcake within the well. Preferably, the baking liner has a corrugated side wall.

It is envisioned that a recess can be provided between interconnected posts to facilitate automated insertion of the baked goods or removal of the baked goods from the wells.

The present disclosure is also directed to a method of forming a container for protecting baked goods, which includes, among other steps, the steps of a) providing a sheet of plastic material that is at least partially transparent; b) forming a cover portion from a portion of the sheet of plastic material, wherein the cover portion includes a planar upper surface; and c) forming a base portion from a portion of the sheet which includes a plurality of wells and a plurality of interconnected posts, each well adapted for supporting a baked good; and the interconnected posts are formed in the base and extend upwardly from a base bottom, each post being positioned adjacent four of the wells and including at least one projecting retainer element positioned proximate an upper end of the post and adapted to positively capture at least one of the baked goods in the four adjacent wells.

It is envisioned that the method could further include the step of: forming a hinge from a portion of the sheet joining the cover portion with the base portion, and wherein the cover portion, base portion, and hinge are unitarily formed from the sheet of plastic material.

The present disclosed is further directed to a container for protecting baked goods during shipment that include, inter alia, a lid; and a base. The base includes a main body portion and an upper peripheral rim, the main body portion defines a plurality of wells and a plurality of interconnected posts, each well is adapted for supporting a baked good. The plurality of interconnected posts extend upwardly from a base bottom, each post is positioned adjacent four of the wells and has a post height adapted to limit rotational movement of the baked goods within the corresponding well.

In certain constructions, the post height for each post is substantially equal a height for the upper peripheral rim of the base. Moreover, in embodiments wherein the baked good is a cupcake with baking liner, the post height for each post is greater than a height of the baking liner.

It should be appreciated that the present invention can be implemented and utilized in numerous ways, including without limitation as a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

Figure 1:
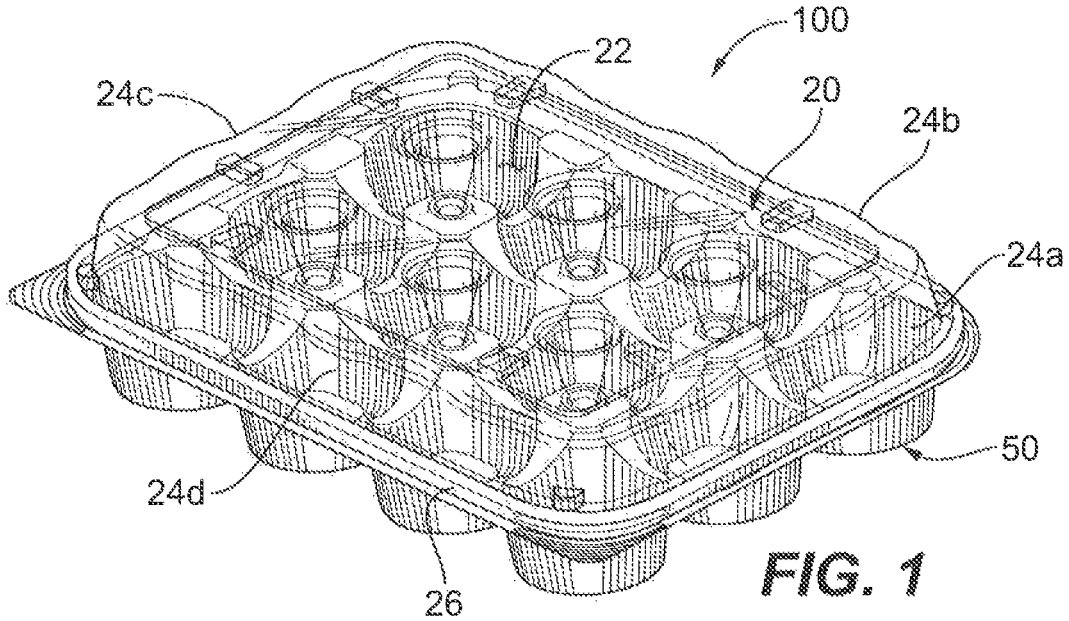
FIG. 1 is a perspective view of a container for protecting baked goods during shipment which has been constructed in accordance with an embodiment of the present disclosure and is shown in the closed position.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment

DETAILED DESCRIPTION OF PREFERRED EMBODIMENTS

Disclosed herein are detailed descriptions of specific embodiments of containers for protecting baked goods during shipment and methods of constructing the same. It will be understood that the disclosed embodiments are merely examples of the way in which certain aspects of the invention can be implemented and do not represent an exhaustive list of all of the ways the invention may be embodied. Indeed, it will be understood that the systems, devices and methods described herein may be embodied in various and alternative forms. Moreover, the figures are not necessarily to scale and some features may be exaggerated or minimized to show details of particular components.

Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

The present disclosure now will be described more fully, but not all embodiments of the disclosure are necessarily shown. In addition, many modifications may be made to adapt a particular situation or material to the teachings of the disclosure without departing from the essential scope thereof.

Referring now to FIGS. 1-5 which disclose a container which has been constructed in accordance with a first embodiment of the present invention and has been designated as reference number 100. Container 100 includes a lid 20 and a base 50.

As best shown in FIG. 1, lid 20 includes a generally planar upper surface 22 onto which a label could be applied. Lid 20 also includes side walls 24*a-d* each of which terminate in at female sealing flange 26.

The base 50 includes a plurality of wells 52*a-c* (quantity 12) each of which are adapted for supporting a single baked good. Wells 52*a* (quantity 4) are positioned in the corner of the base 50; wells 52*b* (quantity 6) are located along the sides of the base 50 and wells 52*c* (quantity 2) are positioned in the interior of the base 50.

Figure 6:
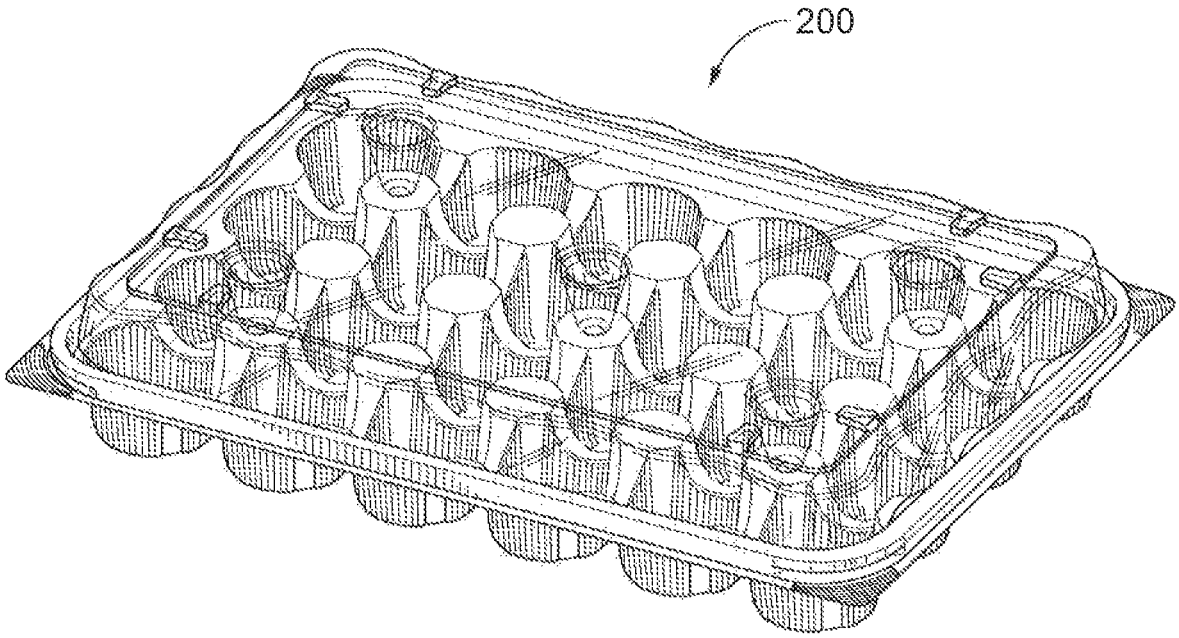
FIG. 6 is a perspective view of a container for protecting baked goods during shipment which has been constructed in accordance with a second embodiment of the present disclosure and is shown in the closed position.
Figure 7:
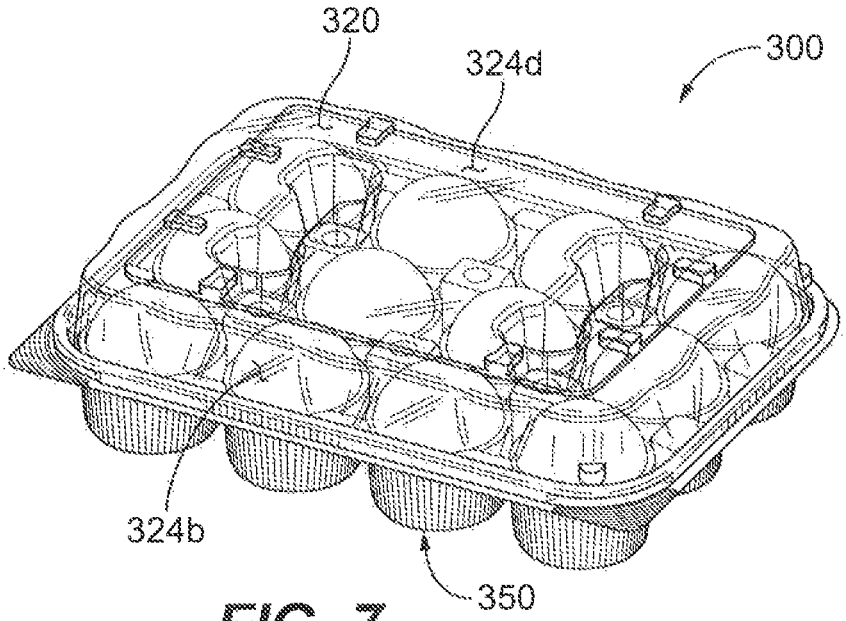
FIG. 7 is a perspective view of a container for protecting baked goods during shipment which has been constructed in accordance with a third embodiment of the present disclosure and is shown in the closed position.

Each well 52 has a well bottom 54 and a well sidewall 56. The container shown in FIGS. 1-4 includes 12 wells and therefore is referred to as a 12-count container. However, those skilled in the art will readily appreciate that they container can include fewer or more wells without departing from the scope of the present invention. For example, FIG. 6 discloses a 24-count container 200 which includes 24 wells.

The base 50 also includes six interconnected posts 60. The interconnected posts 60 are formed in the base 50 and extend upwardly from a base bottom 62. Each post 60 is positioned adjacent to four of the wells 52 and includes a horizontally-projecting retainer element 64 that is positioned proximate an upper end 65 of the post 60 and adapted to positively capture baked goods in each of the four adjacent wells.

Figure 2:
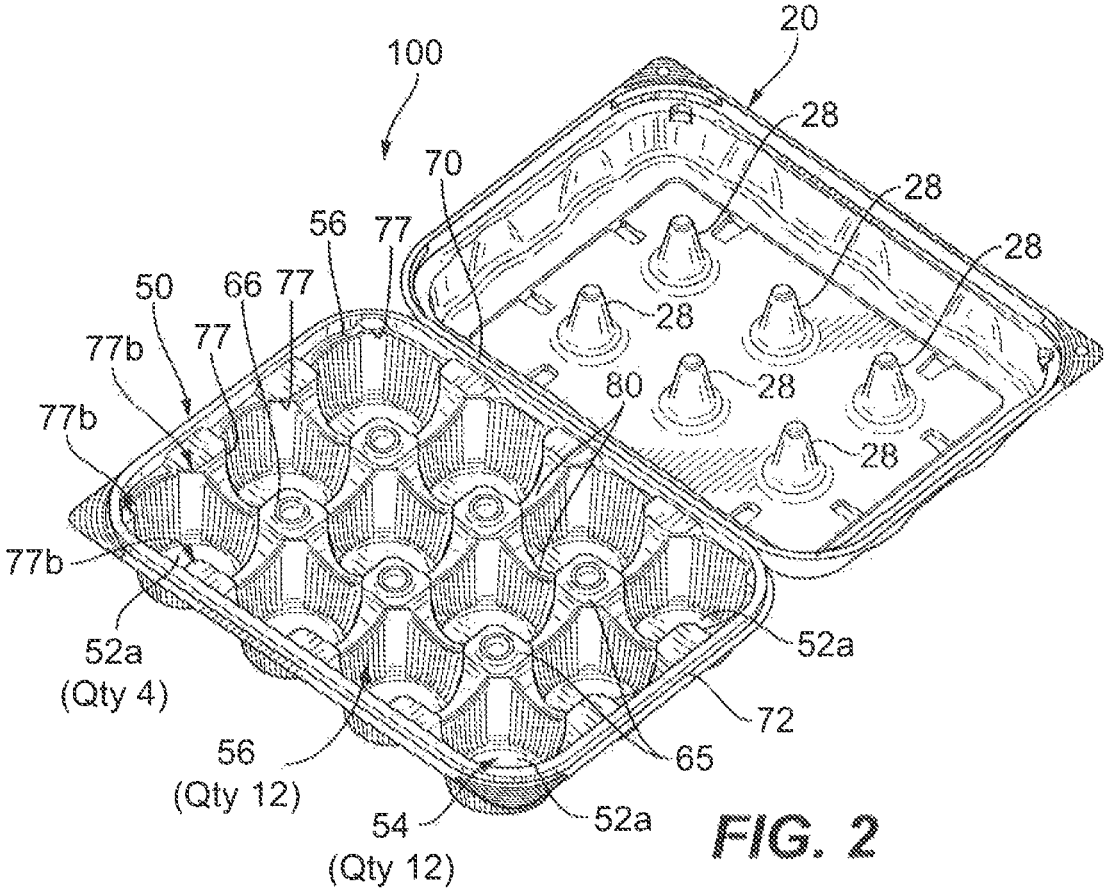
FIG. 2 is a perspective view of the container of FIG. 1 shown in the open position.
Figure 3:
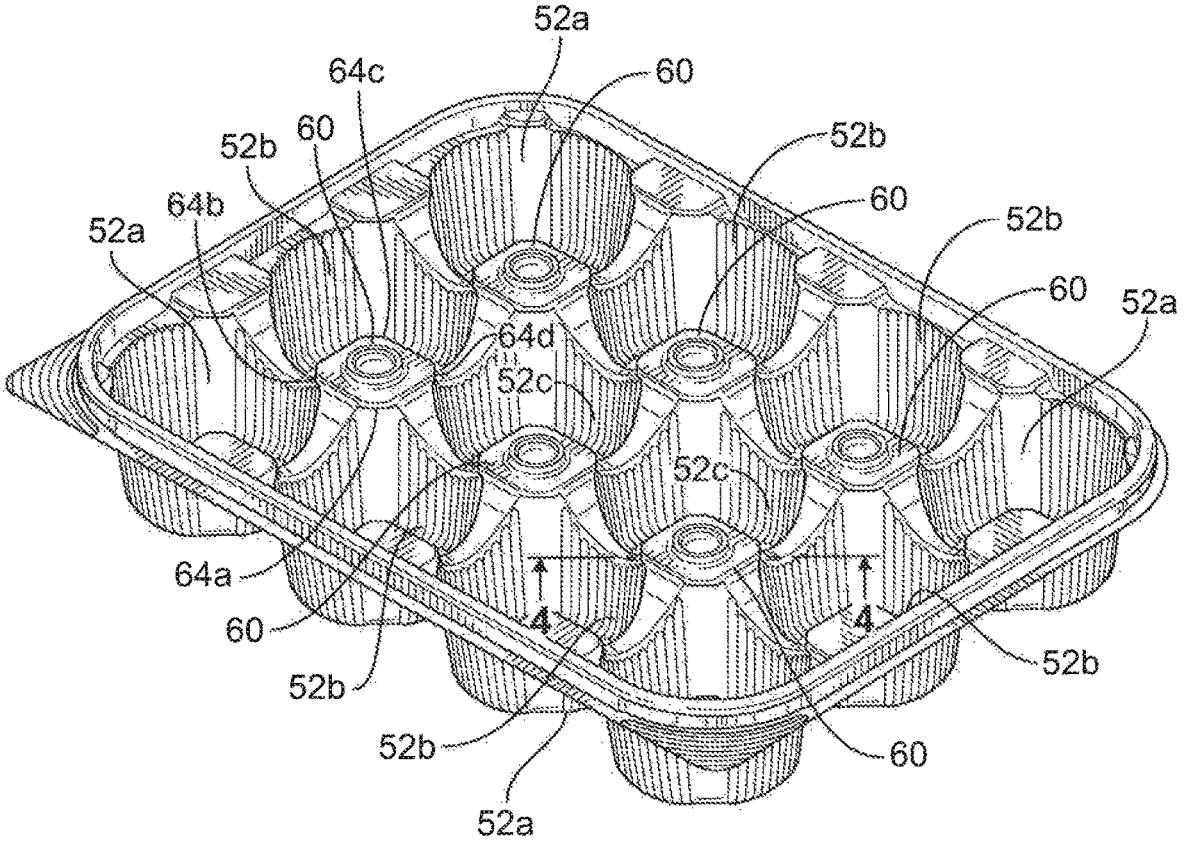
FIG. 3 is a perspective view taken from above of the base portion of the container of FIG. 1.
Figure 4:
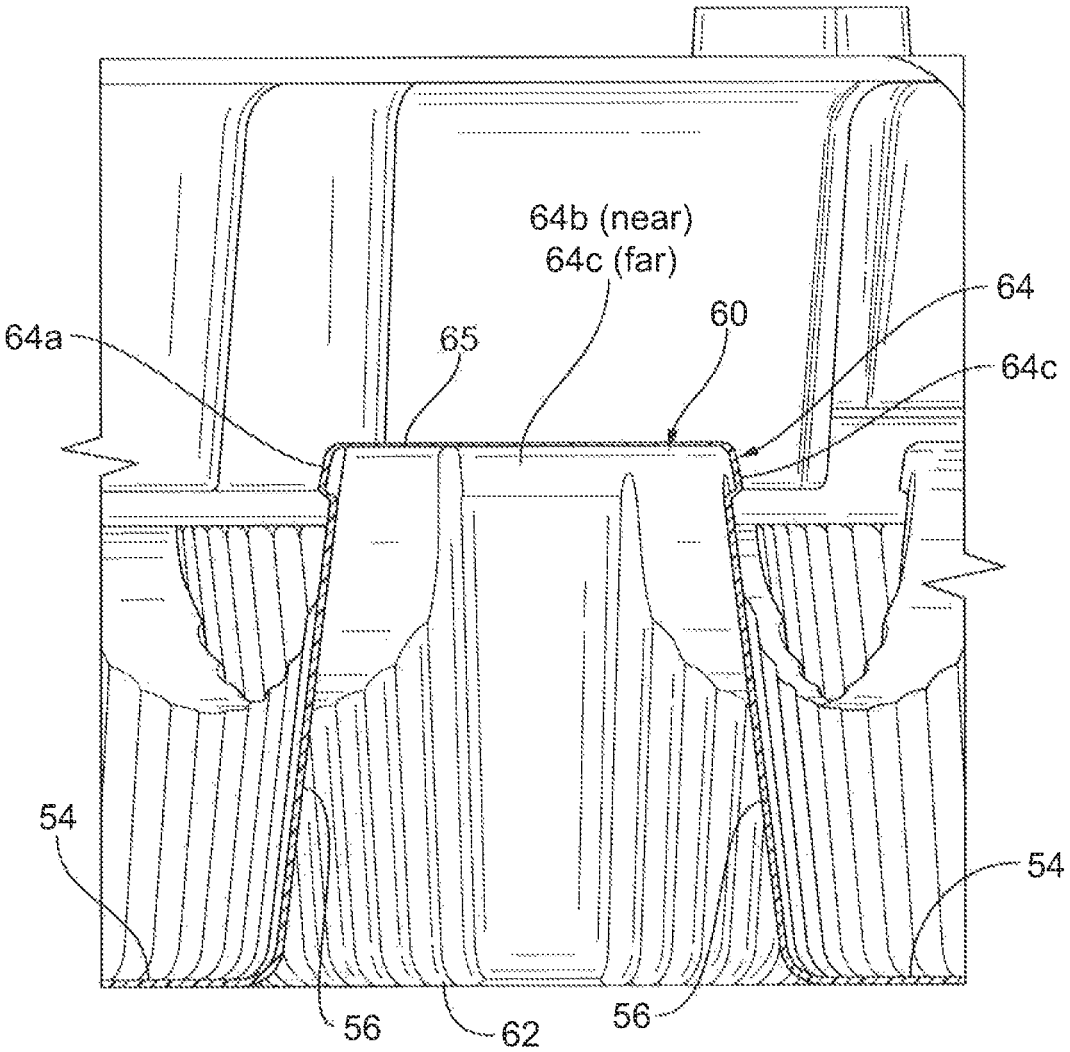
FIG. 4 is a cross-sectional view taken along line 4-4 in FIG. 3 showing a post element formed in the base portion of the container and the undercuts or reliefs used to create the retaining/rib elements.

In the embodiment shown in FIGS. 1-2, lid 20 includes a plurality of downwardly projecting spacer elements 28 which extend from the upper planar surface 22 and engage the upper end 65 of a corresponding post element 60. Six spacer elements 28 are shown in FIG. 2 and the number of spacer elements corresponds to the number of posts 60. However, those skilled in the art will readily appreciate that fewer spacer elements can be used without departing from the scope of the present invention (see FIG. 5 for example). The spacer elements 28 are adapted to prevent the lid 20 of the container from collapsing and damaging the decorative crown of a cupcake if other containers are stacked on top during shipment or display.

In certain embodiments, the retainer element 64 associated with the upper end of each post includes four ribs 64*a*-64*d* which are spaced around the periphery of the post 60 and each rib 64*a*-64*d* projects horizontally outward from the post 60 over one of the adjacent wells 52. As will be discussed in detail with respect to FIGS. 7-10, in certain embodiments, each post may only include a single rib or less than four ribs. The ribs can be formed by creating an undercut in the mold used to form the base and associated posts.

In the embodiment shown in FIGS. 1-4, the lid 20 is connected to the base 50 through a hinge element 70 to form a unitary structure. However, those skilled in the art will readily appreciate that the lid and the base can be formed separately.

The base 50 also includes an upper peripheral rim/male sealing flange 72 which engages with the female sealing flange 26 associated with the lid 20 to seal the container in the closed position.

As shown in FIG. 2, the number of wells (52) designated as "W" formed in the base 50 is defined by the formula W=R×C; wherein "R" equals the number of well rows and "C" equals the number or well columns. Still further, the number of posts (60) designated as "P" formed in the base is defined by the formula, P=(R−1)×(C−1).

As shown in FIG. 2, the upper surface of each well 52*b* that is formed along a side wall of the base 50 includes two horizontally projecting retaining ledges 77*a*. Still further, the upper surface of each well 52*a* that is formed in a corner of the base includes three retaining ledges 77*a*, 77*b* and 77*b*. These ledges 77 provide additional mechanisms for restraining the baked goods within the wells.

Figure 5:
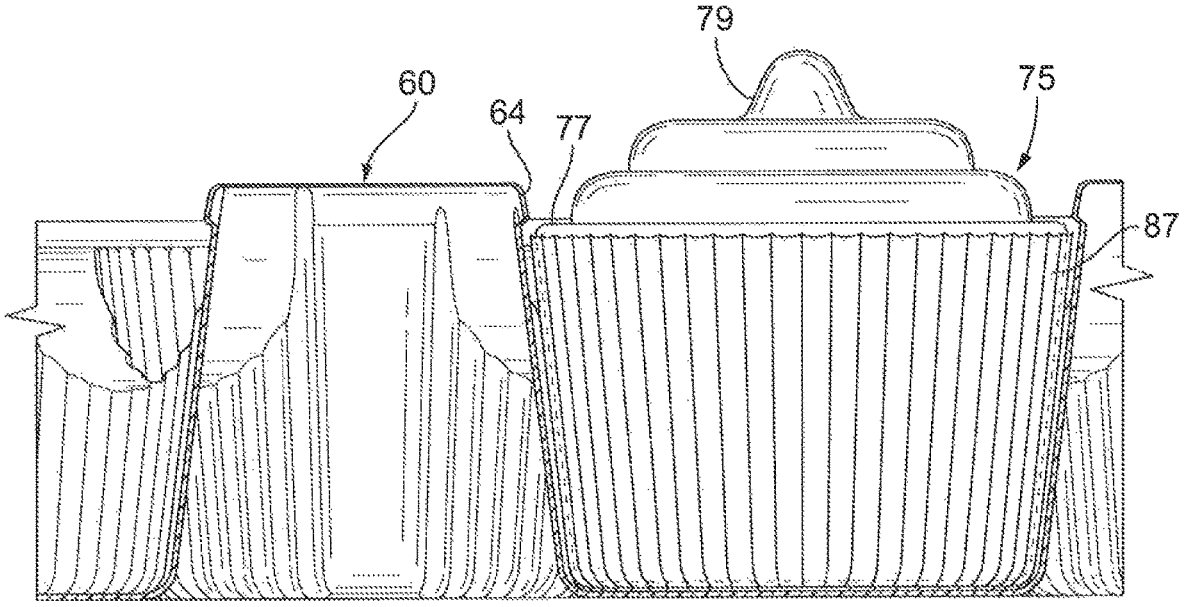
FIG. 5 is a is a cross-sectional view illustrating a cupcake and baking liner positioned within one of the wells formed in the base wherein the baking liner is being restrained by the restraining rib formed on the post.

As discussed previously, the baked goods stored in container 100 can be cupcakes 75 that has a cake portion 77 and a decorative crown 79. In such situations, as shown in FIG. 5, the length and height of the retaining element and/or ledges are sized to positively capture an upper edge of the cake portion after the cupcake has been inserted into the well 52. Moreover, as shown in FIG. 5, if the cupcake is contained in baking liner 87 the length and height of the retaining element and/or ledges can be sized to positively capture an upper edge of the baking liner after the cupcake has been inserted into the well 52. If a baking liner is used, a corrugated liner would be preferred because it would be easier to retrain using the retaining element and/or ledges due to its zig-zag cross-section providing more width to lay over.

As shown in FIG. 2 a series of recesses 80 can be provided between interconnected posts 60 to facilitate removal of baked goods from the wells 52. They also aid in the insertion of the baked goods into the wells, especially if automated equipment is used for the loading process.

Referring now to FIGS. 7-10 which disclose a container which has been constructed in accordance with a third embodiment of the present disclosure and has been designated as reference number 300. Like the previously described containers, container 300 includes a lid 320 and a base 350.

Figure 8:
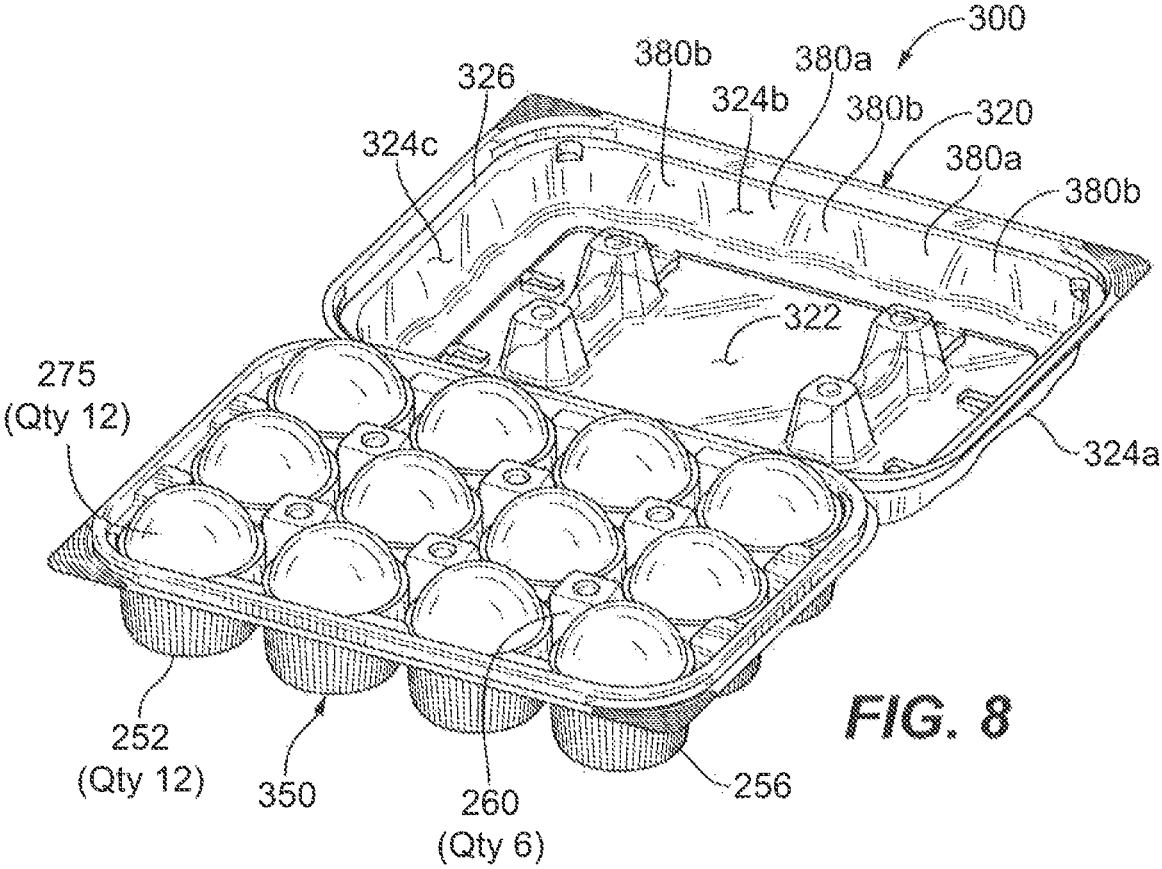
FIG. 8 is a perspective view of the container of FIG. 7 shown in the open position.
Figure 9:
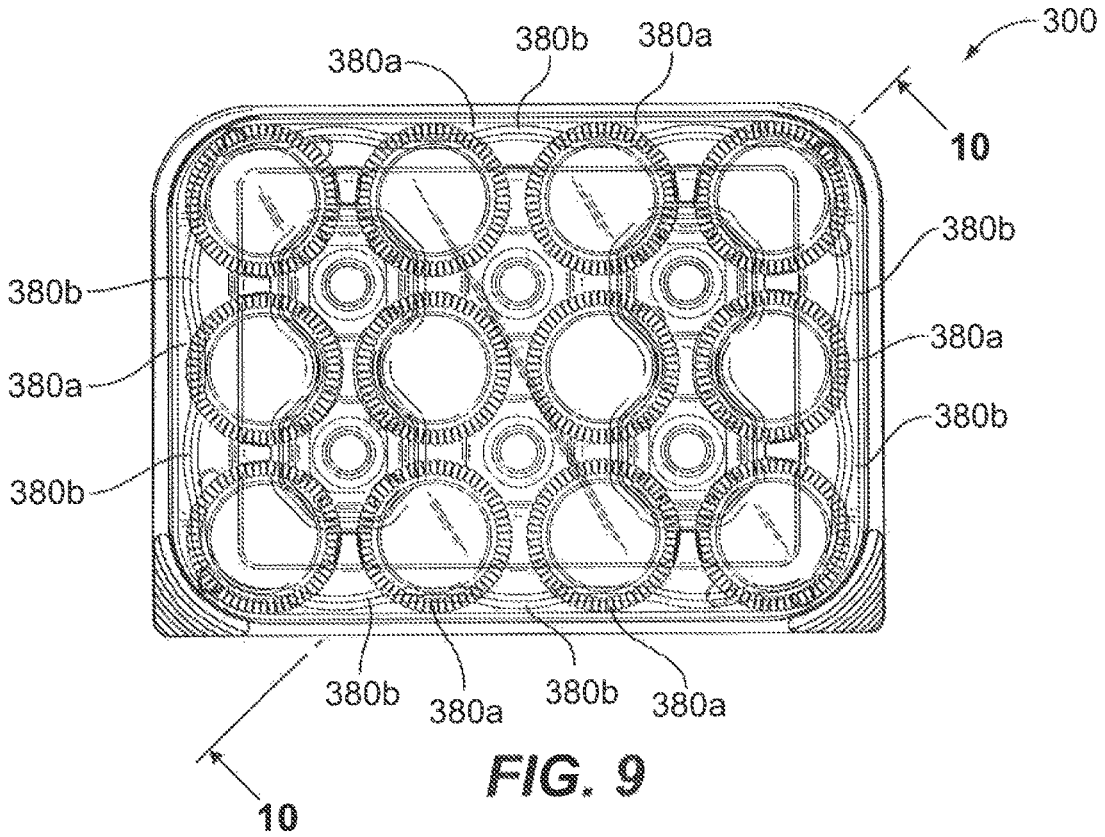
FIG. 9 is a perspective view taken from above of the base portion of the container of FIG. 7.

As best shown in FIG. 8, lid 320 includes a generally planar upper surface 322 onto which a label could be applied. Lid 320 also includes side walls 324*a-d* each of which terminate at female sealing flange 326.

Figure 10:
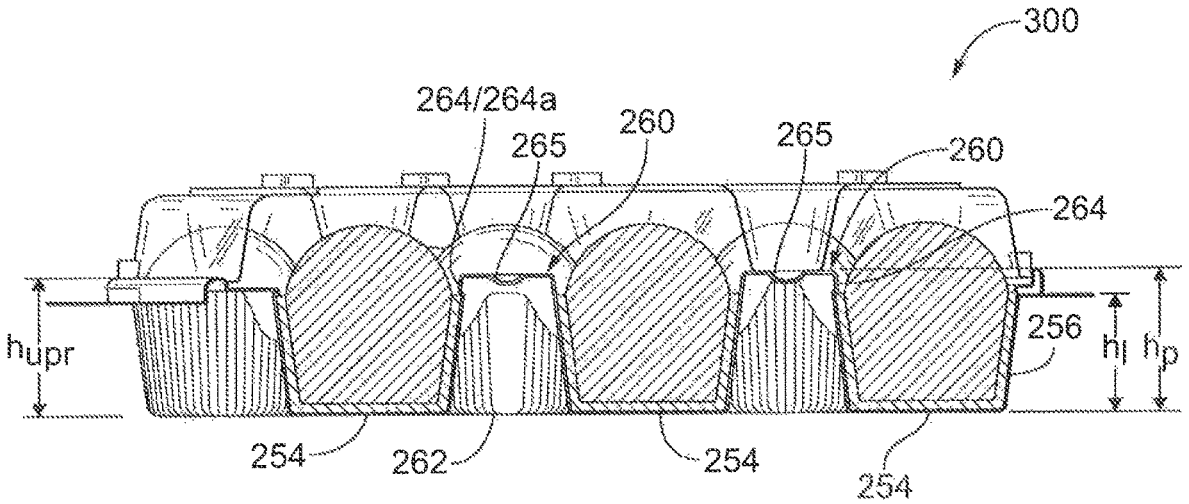
FIG. 10 is a cross-sectional view taken along line 10-10 in FIG. 9 showing the post elements formed in the base portion of the container and the undercuts or reliefs used to create the retaining/rib elements.

The base 350 includes a plurality of wells 252 (quantity 12) each of which is adapted for supporting a single baked good 275. Each well 252 has a well bottom 254 and a well sidewall 256. The base 250 also includes six interconnected posts 260. The interconnected posts 260 are formed in the base 250 and extend upwardly from a base bottom 262. As shown in FIG. 10, the height of the posts is designated as $h_p$. In certain constructions, the height of the posts can be increased in order to further restrict the rotational movement of the baked good within the closed container. Longer posts will reduce the ability of the baked goods to rotate within the container during shipment.

As best viewed in FIG. 10, each post 260 is positioned adjacent to four of the wells 252 and includes a horizontally-projecting retainer element 264 that is positioned proximate an upper end 265 of the post 260 and adapted to positively capture baked goods in each of the four adjacent wells. Unlike in the previously described embodiments, the retainer element 264 associated with the upper end of each post includes only a single rib 264*a* that projects horizontally outward from the post 260 over one of the adjacent wells 252. As discussed previously, depending on the application or desired amount of restraint and the number of baked goods to be restrained by a post, the post may only include a single rib or multiple ribs.

The base 250 also includes an upper peripheral rim/male sealing flange 72 which engages with the female sealing flange 26 associated with the lid 20 to seal the container in the closed position. The height of the upper peripheral rim of the base has been designated as $h_{upr}$.

Like the previously described container 100, the upper surface or rim area of each well 252 can include horizontally projecting retaining ledges. These ledges can provide additional mechanisms for restraining the baked goods within the wells.

Additionally, the sidewalls 324*a*-324*d* of the lid 320 can arranged so as to be positioned over the outer periphery of the underlying well when the container is closed in order to provide a lower edge which restricts the movement of the baked goods. In the embodiment shown in the figures, the sidewalls 324*a*-324*d* are formed from a series of relatively flat sections 380*a* and arcuate sections 380*b* wherein the flat sections 380*a* are positioned over the outer periphery of the underlying wells and restrict the movement of the baked goods when the container is closed.

As noted previously, the post height is adapted to limit rotational movement of the baked goods within the corresponding well. In certain constructions, the post height $h_p$ for each post is substantially equal a height for the upper peripheral rim $h_{upr}$ of the base. Moreover, in embodiments wherein the baked good is a cupcake with baking liner, the post height $h_p$ for each post is greater than a height of the baking liner $h_l$.

A representative method for forming a container which is constructed in accordance with a preferred embodiment of the present disclosure includes, among other steps, the steps of a) providing a sheet of plastic material that is at least partially transparent; b) forming a cover portion from a portion of the sheet of plastic material, wherein the cover portion includes a planar upper surface; c) forming a base portion from a portion of the sheet which includes a plurality of wells and a plurality of interconnected posts, each well adapted for supporting a baked good; and the interconnected posts are formed in the base and extend upwardly from a base bottom, each post being positioned adjacent four of the wells and including at least one horizontally-projecting retainer element positioned proximate an upper end of the post and adapted to positively capture a baked good in an adjacent well; and d) forming a hinge from a portion of the sheet joining the cover portion with the base portion, and wherein the cover portion, base portion, and hinge are unitarily formed from the sheet of plastic material.

It should be readily understood that a container constructed in accordance with the present invention, which is preferably a plastic container used for carrying edible items, can be manufactured in a variety of shapes and sizes, and can be formed from resins or plastic materials such as polyethylene, polypropylene, polyvinyl chloride or polyethylene terephthalate ("PETE"), as well as other suitable materials or combinations thereof. The forming process can also vary to include methods such as thermo-forming, injection molding or blow molding. The container can be transparent or translucent, and may be colored in either instance. Also, vents can be provided in the container to promote airflow therethrough, if appropriate based on the intended contents of the container. Preferably, container 100 is formed from a roll of PETE subjected to a vacuum and pressure mold with plug assist.

What is claimed is:

1. A container for protecting baked goods during shipment, comprising:

a lid; and a base which includes a plurality of wells, each well including a well bottom and a well sidewall and being adapted for receiving and supporting a baked good; and wherein a plurality of interconnected center posts are formed in the base and extend upwardly from a base bottom, each center post being positioned adjacent four of the wells and connected to adjacent center posts through a well sidewall and the well sidewall forming a recess between adjacent centerposts and each center post including at least one retainer shoulder formed proximate an upper end of the center post and positioned higher than a trough of the recess between adjacent centerposts and arranged to positively capture and restrain axial movement of the baked goods in each of the four adjacent wells; and wherein the base further includes a plurality of side wall posts formed along front, back, left and right ends of the base, each sidewall post positioned adjacent two of the wells and connected to adjacent center posts through a well sidewall, each sidewall post including at least one retainer shoulder formed on an upper end of the sidewall post and arranged to positively capture and restrain axial movement of the baked goods in each of the two adjacent walls.

2. The container as recited in claim 1, wherein the base further include a plurality of corner posts, each corner post positioned adjacent a single well and connected to an adjacent sidewall post through a well sidewall, each corner post including at least one retainer shoulder formed on an upper end of the corner post and arranged to positively capture and restrain axial movement of the baked goods in the adjacent well.

3. The container as recited in claim 1, wherein the at least one retainer shoulder formed on the upper end of each center post includes four ribs spaced around the periphery of the center post, each rib projecting horizontally outward from the center post over a portion of one of the adjacent wells.

4. The container as recited in claim 1, wherein the lid includes a planar upper surface for supporting a product label.

5. The container as recited in claim 1, wherein the lid includes a plurality of downwardly projecting spacer elements which extend from an upper planar surface and engage an upper surface of a corresponding post element.

6. The container as recited in claim 1, wherein the lid is connected to the base through a hinge element to form a unitary structure.

7. The container as recited in claim 1, wherein the number of wells "W" is defined by the formula W=R.times.C wherein "R" equals the number of well rows and "C" equals the number or well columns.

8. The container as recited in claim 5, wherein the number of center posts "P" formed in the base is defined by the formula, P=(R−1).times.(C−1).

9. The container as recited in claim 1, wherein the at least one retainer shoulder formed on the upper end of each sidewall post includes at least two horizontally projecting retaining ledges.

10. The container as recited in claim 2, wherein the at least one retainer shoulder formed on the upper end of each corner post includes at least two horizontally projecting retaining ledges.

11. The container as recited in claim 1, wherein the baked good is a cupcake that has a cake portion and a decorative crown and the retaining shoulders are positioned to positively capture an upper edge of the cake portion.

12. The container as recited in claim 1, wherein the baked good is a cupcake which is contained in a baking liner and the retaining shoulders extends over an upper edge of the baking liner to positively capture the cupcake.

13. The container as recited in claim 1, wherein the recess facilitates removal of baked goods from the wells.

14. A container for protecting baked goods during shipment, comprising:

a lid; and a base which includes a plurality of wells, each well including a well bottom and a well sidewall and being adapted for receiving and supporting a baked good; and wherein a plurality of interconnected center posts are formed in the base and extend upwardly from a base bottom, each center post being positioned adjacent four of the wells and connected to adjacent center posts through a well sidewall and the well sidewall forming a recess between adjacent centerposts and each center post including at least one retainer shoulder formed proximate an upper end of the center post and positioned higher than the a trough of the recess between adjacent centerposts and arranged to positively capture and restrain axial movement of the baked goods in each of the four adjacent wells; and wherein the base further includes a plurality of corner posts, each corner post positioned adjacent a single well and connected to an adjacent sidewall post through a well sidewall, each corner post including at least one retainer shoulder formed on an upper end of the corner post and arranged to positively capture and restrain axial movement of the baked goods in the adjacent well.

* * * * *